US010173809B2

(12) United States Patent
Tracy

(10) Patent No.: US 10,173,809 B2
(45) Date of Patent: Jan. 8, 2019

(54) RESEALABLE FLEXIBLE PACKAGES

(71) Applicant: BEMIS COMPANY, INC., Neenah, WI (US)

(72) Inventor: Jordan R. Tracy, Appleton, WI (US)

(73) Assignee: Bemis Company, Inc., Neenah, WI (US)

( * ) Notice: Subject to any disclaimer, the term of this patent is extended or adjusted under 35 U.S.C. 154(b) by 0 days.

(21) Appl. No.: 15/311,302

(22) PCT Filed: May 19, 2014

(86) PCT No.: PCT/US2014/038605
§ 371 (c)(1),
(2) Date: Nov. 15, 2016

(87) PCT Pub. No.: WO2015/178882
PCT Pub. Date: Nov. 26, 2015

(65) Prior Publication Data

US 2017/0088313 A1 Mar. 30, 2017

(51) Int. Cl.
*B65D 33/00* (2006.01)
*B65D 33/20* (2006.01)
*B65D 75/58* (2006.01)

(52) U.S. Cl.
CPC ..... *B65D 33/20* (2013.01); *B65D 75/5805* (2013.01); *B65D 75/5827* (2013.01); *B65D 75/5855* (2013.01); *B65D 2575/586* (2013.01)

(58) Field of Classification Search
CPC ..... B65D 33/20; B65D 75/5805; B65D 75/5855; B65D 2575/586
USPC ..... 383/204
See application file for complete search history.

(56) References Cited

U.S. PATENT DOCUMENTS 3,967,729 A * 7/1976 Tanner, II ..... A61F 15/001 206/440
3,991,881 A * 11/1976 Augurt ..... B65D 75/30 116/206
4,057,144 A * 11/1977 Schuster ..... B65D 33/01 206/439
4,168,779 A * 9/1979 Yokokoji ..... B32B 27/10 206/439
4,270,658 A * 6/1981 Schuster ..... B65D 31/02 206/439
4,367,816 A * 1/1983 Wilkes ..... A61B 50/30 206/439
4,402,453 A 9/1983 Regenstein, Jr.
4,407,874 A * 10/1983 Gehrke ..... B32B 27/32 428/35.2

(Continued)

FOREIGN PATENT DOCUMENTS

EP 0396428 A1 11/1990
WO 2012154655 A1 11/2012

*Primary Examiner* — Peter Helvey

(57) ABSTRACT

A resealable flexible package is provided comprising polymeric wall panels and a peel-reseal feature sealed therebetween. A peel-off portion is removed to transition the package from a closed position to an open position, removal of the peel-off portion both opening the package and exposing a pressure sensitive adhesive of the peel-reseal feature. The exposed pressure sensitive adhesive is coupled to one of the wall panels and moved into adhesive engagement with an exterior surface of another wall panel to transition the package to a reseated position.

24 Claims, 9 Drawing Sheets

(56) References Cited

U.S. PATENT DOCUMENTS 4,514,965 A * 5/1985 Adachi ..... B65B 9/02 53/553
4,550,546 A * 11/1985 Raley ..... B65D 65/38 206/439
4,654,240 A * 3/1987 Johnston ..... B32B 27/08 206/524.6
4,657,804 A * 4/1987 Mays ..... D04H 1/54 156/182
4,660,721 A * 4/1987 Mykleby ..... A61L 2/26 206/438
4,724,961 A * 2/1988 Shimoyamada ..... B32B 27/32 206/439
4,778,697 A * 10/1988 Genske ..... B29C 47/0021 428/35.2
4,785,940 A 11/1988 Wilson
4,857,409 A * 8/1989 Hazelton ..... B29C 47/0021 428/35.2
4,937,139 A * 6/1990 Genske ..... B29C 47/0019 428/349
4,941,196 A 7/1990 Edelman et al.
4,965,109 A * 10/1990 Tucker ..... B32B 27/08 428/332
5,071,686 A * 12/1991 Genske ..... B32B 27/32 428/35.7
5,073,436 A * 12/1991 Antonacci ..... D04H 1/56 428/219
5,089,308 A * 2/1992 Nordness ..... B29C 47/0021 428/35.4
5,093,164 A * 3/1992 Bauer ..... B29C 47/0021 428/349
5,108,844 A * 4/1992 Blemberg ..... B32B 27/08 428/518
5,174,659 A 12/1992 Laske
5,205,649 A 4/1993 Fullerton
5,230,430 A * 7/1993 Kidder ..... A01G 1/046 206/439
5,459,978 A 10/1995 Weiss et al.
5,836,444 A 11/1998 Hoevel et al.
5,842,326 A * 12/1998 Wolf ..... A61L 2/0023 422/25
5,879,620 A * 3/1999 Cohen ..... A61L 2/26 422/1
5,882,749 A 3/1999 Jones et al.
5,922,428 A * 7/1999 Pufahl ..... A61L 2/26 206/411
5,947,288 A * 9/1999 Dykstra ..... A61L 2/26 206/439
5,954,431 A 9/1999 Fabel
5,976,299 A * 11/1999 Ivey ..... B08B 3/041 134/122 R
6,012,844 A 1/2000 Huseman et al.
6,059,112 A * 5/2000 Dykstra ..... A61L 2/26 206/438
6,073,767 A * 6/2000 Cohen ..... A61L 2/26 206/363
6,098,800 A * 8/2000 Bennish, Jr. ..... A61L 2/26 206/438
6,117,505 A * 9/2000 Weiss ..... A61L 2/07 428/35.2
6,156,363 A 12/2000 Chen et al.
6,182,850 B1 * 2/2001 Marbler ..... B65D 77/225 220/359.3
6,196,716 B1 3/2001 Geyer
6,251,489 B1 * 6/2001 Weiss ..... A61L 2/07 206/438
6,254,519 B1 * 7/2001 Toshima ..... B65D 75/5894 383/204
6,279,745 B1 * 8/2001 Huynen ..... B29C 65/18 206/439
6,436,341 B1 * 8/2002 Gammons ..... A61L 2/07 206/439
6,502,986 B1 1/2003 Bensur et al.
6,616,998 B2 * 9/2003 Greer ..... B32B 27/36 428/213
6,844,038 B2 * 1/2005 Gollier ..... B29C 65/76 428/349
7,041,352 B2 * 5/2006 Barber ..... B32B 27/32 428/36.7
7,045,183 B2 * 5/2006 Amano ..... B65D 75/58 428/347
7,069,074 B2 * 6/2006 Covey ..... A61N 1/3968 607/5
7,160,590 B2 * 1/2007 Vanhamel ..... A61L 2/07 428/35.7
7,703,980 B2 * 4/2010 Sampaio Camacho ..... B65D 33/20 383/203
7,718,433 B2 * 5/2010 Stecklein ..... A61L 2/07 422/119
7,797,911 B2 * 9/2010 Zambaux ..... A61L 2/26 53/425
8,371,446 B2 * 2/2013 Tschantz ..... B65D 81/052 206/522
8,562,216 B2 10/2013 Kendall et al.
8,622,618 B2 1/2014 Moehlenbrock
8,839,955 B1 * 9/2014 Klinsport ..... A46B 17/04 206/362.2
9,090,383 B2 * 7/2015 Forman ..... B65D 75/40
9,095,324 B2 * 8/2015 Peck ..... A61B 19/026
9,096,368 B2 * 8/2015 Wu ..... A61F 2/0095
9,392,866 B1 * 7/2016 Klinsport ..... A46B 17/04
9,533,813 B1 * 1/2017 Conrad ..... B65D 75/5838
2010/0111453 A1 5/2010 Dierl
2011/0036741 A1 2/2011 Moehlenbrock
2011/0038569 A1 2/2011 Huffer et al.
2011/0038570 A1 2/2011 Moehlenbrock et al.
2011/0038571 A1 2/2011 Moehlenbrock
2012/0195526 A1 8/2012 Moehlenbrock et al.
2012/0195527 A1 8/2012 Moehlenbrock et al.
2012/0195531 A1 8/2012 Moehlenbrock et al.
2012/0207408 A1 8/2012 Moehlenbrock et al.
2012/0207410 A1 8/2012 Moehlenbrock
2012/0207412 A1 8/2012 Moehlenbrock et al.
2012/0224795 A1 9/2012 Moehlenbrock
2013/0121623 A1 5/2013 Lyzenga et al.
2013/0209000 A1 8/2013 Owensby et al.
2013/0209004 A1 8/2013 Owensby et al.
2013/0209005 A1 8/2013 Owensby et al.

* cited by examiner

RESEALABLE FLEXIBLE PACKAGES

BACKGROUND

The present disclosure relates generally to the field of packages. More specifically, the present disclosure relates to flexible packages that are resealable.

SUMMARY

An exemplary embodiment relates to a resealable flexible package including a closed position, an open position, and a resealed position. The package comprises a top end; a bottom end generally opposite the top end; a first wall panel including an interior surface and an exterior surface; a second wall panel including an interior surface and an exterior surface, the second wall panel being generally opposite the first wall panel; and a peel-reseal feature disposed between the interior surface of the first wall panel and the interior surface of the second wall panel. The peel-reseal feature comprises a first heat-sealable panel; a second heat-sealable panel; and a pressure sensitive adhesive disposed substantially between the first heat-sealable panel and the second heat-sealable panel. The package further comprises a first portion of the first wall panel, the first portion configured to be separated from a second portion of the first wall panel when transitioning from the closed position to the open position. In the closed position, the first heat-sealable panel of the peel-reseal feature is coupled to the interior surface of the first wall panel at the first portion of the first wall panel and the second heat-sealable panel of the peel-reseal feature is coupled to the interior surface of the second wall panel. In the open position, an opening is provided and the first portion of the first wall panel is separated from the second portion of the first wall panel. Separating the first portion of the first wall panel from the second portion of the first wall panel also separates a first portion of the peel-reseal feature from a second portion of the peel-reseal feature, the second portion of the peel-reseal feature remaining coupled to the interior surface of the second wall panel. In the resealed position, the pressure sensitive adhesive is adhered to an exterior surface of the first wall panel and is disposed between the first wall panel and the second wall panel, the exterior surface of the second wall panel being distal to the pressure sensitive adhesive relative to the interior surface of the second wall panel.

Another exemplary embodiment relates to a resealable flexible package comprising a top end generally opposite a bottom end; a first wall panel generally opposite a second wall panel, both the first wall panel and the second wall panel extending generally between the top end and the bottom end; and a peel-reseal feature disposed between an interior surface of the first wall panel and an interior surface of the second wall panel. The peel-reseal feature comprises a skin layer coupled to the interior surface of one of the first wall panel and the second wall panel, the skin layer configured to fail when transitioning from the closed position to the open positioned; a bulk panel coupled to the interior surface of the other of the first wall panel and the second wall panel, the bulk panel configured to remain substantially intact when transitioning from the closed position to the open positioned; and a pressure sensitive adhesive disposed generally between the skin layer and the bulk panel. The package further comprises a peel-off portion, the peel-off portion including a first portion of the first wall panel and a first portion of the peel-reseal feature, and a line of weakness in the first wall panel. The first portion of the first wall panel is disposed to one side of the line of weakness and a second portion of the first wall panel is disposed to the other side of the line of weakness.

Another exemplary embodiment relates to a resealable flexible package having a closed position, an open position, and a resealed position. The package comprises a top end; a bottom end generally opposite the top end; a first wall panel including an interior surface, an exterior surface, and a removable portion; a second wall panel including an interior surface and an exterior surface; and a peel-reseal feature disposed between the interior surface of the first wall panel and the interior surface of the second wall panel. The peel-reseal feature comprises a first panel coupled to the interior surface of the first wall panel by a first heat seal; a second panel coupled to the interior surface of the second wall panel by a second heat seal; and a pressure sensitive adhesive disposed generally between the first panel and the second panel. The package further comprises a peel-off portion including at least the removable portion of the first wall panel and a first portion of the peel-reseal feature; a line of weakness disposed at or below a bottom end of the first heat seal; and a reseal surface disposed below the line of weakness, the reseal surface being a portion of the exterior surface of the first wall panel.

DETAILED DESCRIPTION

Referring generally to the FIGURES, disclosed herein are packages 10 that are resealable, flexible packages that include a closed position, an open position, and a resealed position. The packages can be transitioned from the closed position to the open position. The packages can also be repeatedly transitioned between the open position and the resealed position.

The configuration of the packages is such that transitioning a package from one position to another is intuitive for a consumer. Significantly, in a single step a consumer can both open the package and expose a pressure sensitive adhesive that provides for the package to be transitioned to the resealed position.

The packages of this disclosure are also configured to be efficiently manufactured. It is anticipated that the packages will be commonly utilized in applications wherein the package is considered disposable. For such applications, a package configuration that is overly complex or otherwise does not lend itself to efficient manufacture is generally cost and/or time prohibitive.

Other benefits of the packages are numerous and will be apparent upon review of this disclosure.

Figure 1:
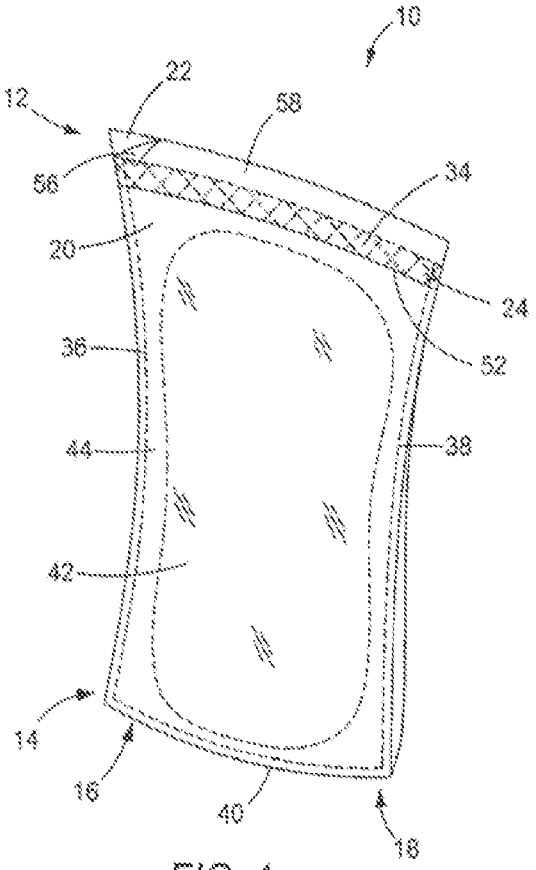
FIG. 1 is a perspective view of a package in a closed position according to an exemplary embodiment.
Figure 2A:
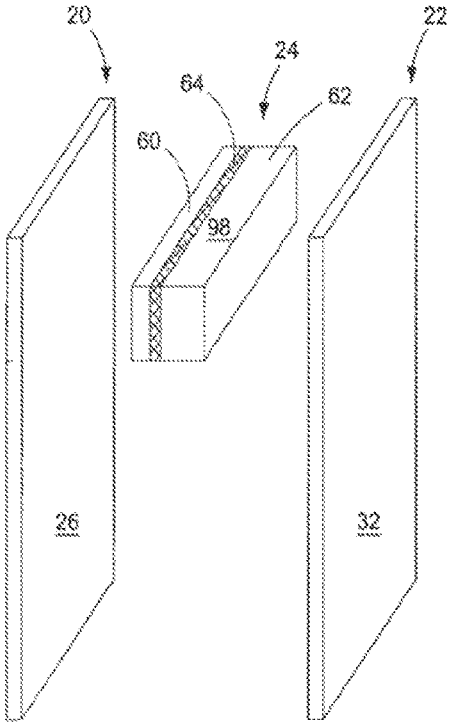
FIG. 2A is a perspective, partially exploded detail view of the package shown in FIG. 1.
Figure 2B:
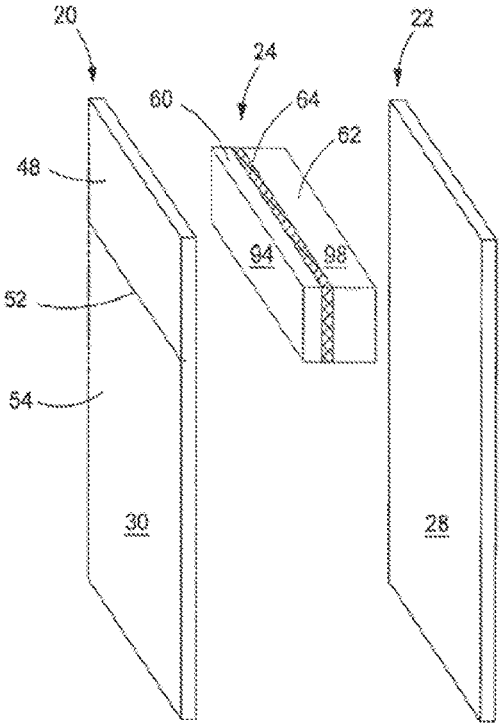
FIG. 2B is a perspective, partially exploded detail view of he package shown in FIG. 1.

FIGS. 1-2B illustrate an exemplary embodiment of a package 10 that is a flexible package including a top end 12 generally opposite a bottom end 14, a first side 16 generally opposite a second side 18, a first wall panel 20 generally opposite a second wall panel 22, and a peel-reseal feature 24 that extends substantially transversely the width of the package 10 from the first side 16 to the second side 18. The first wall panel 20 and the second all panel 22 are polymeric webs that each includes an interior surface 26, 28 and an exterior surface 30, 32, respectively. The peel-reseal feature 24 is shown disposed between and coupled to the interior surface 26 of the first wall panel 20 and the interior surface 28 of the second wall panel 22 by a top heat seal 34, which also thereby couples the first wall panel 20 to the second wall panel 22 at the top end 12 of the package 10. A first side heat seal 36 and second side heat seal 38 couple the first wall panel 20 to the second wall panel 22 at the first side 16 and second side 18 of the package 10, respectively. An optional bottom heat seal 40 is shown coupling the first wall panel 20 to the second wall panel 22 at the bottom end 14 of the package 10. According to other exemplary embodiments, the package forming method includes folding over a single polymeric web to create a fold at a bottom end of the package, eliminating the need for a bottom heat seal. According to still other exemplary embodiments, adhesives or other suitable methods for bonding or sealing a package may replace one or more of the side and/or bottom heat seals or portions thereof.

The package 10 provides storage and protection for a product 42 disposed in a cavity 44. The product 42 may be any product that would benefit from protection and/or storage by the packages of this disclosure. The packages of this disclosure are particularly beneficial for products that may not be entirely consumed or otherwise utilized at one time (e.g., shelf-stable snacks, candy, dried fruit, shaving blades, fishing lures, etc.). For these products, the resealability of the package allows the product to remain in the package after an initial use and be stored therein until a later use. Thus, a consumer avoids the need to transfer the product to another receptacle for storage after opening and benefits from the package being already configured to properly store and protect the product therein.

While it is anticipated the end-consumer will typically utilize the package with the product already in the cavity (e.g., interior space, chamber, pouch, area, gap, etc.) when the package is in the closed position, that need not be the case. A consumer may utilize a package that is in the closed position but contains no product. For example, one or more packages may be purchased by the end user to be utilized in separating and storing a product (e.g., a snack food). In this case, the package configuration maintains an interior storage space that is clean and ready for use, allowing product of the consumer's choice to be safely disposed into and sealed in that cavity after the package is opened.

While the package 10 is shown as a pouch-style package, the package may have any configuration well-suited for use with the peel-reseal functionality disclosed therein. For example, stand-up pouches, flow wrap, pillow packs (e.g., sliced cheese packaging), and thermoformed thin webs with top films.

Figure 8:
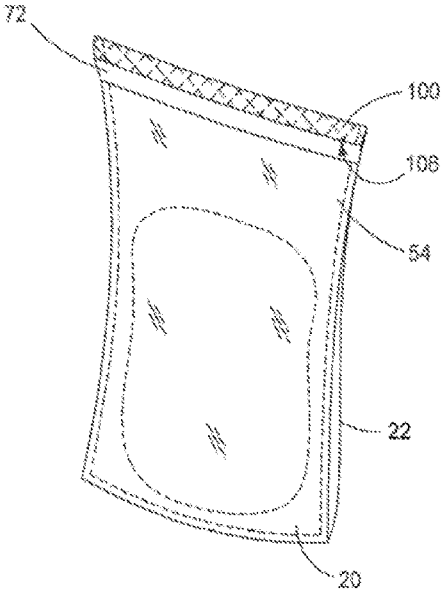
FIG. 8 is a perspective view of a package in a resealed position according to the exemplary embodiment of FIG. 1.
Figure 9:
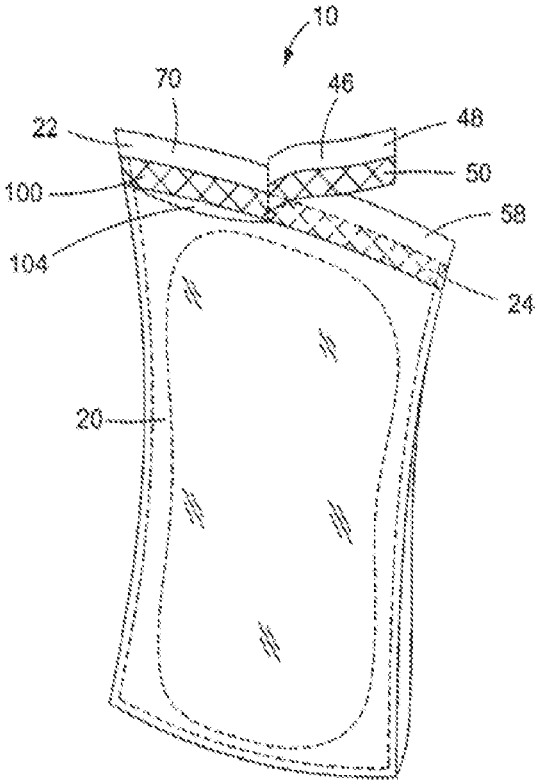
FIG. 9 is a perspective view of a package transitioning from the closed position to the open position according to the exemplary embodiment of FIG. 1.

Referring to FIG. 9, the package 10 further includes a removable portion shown as a peel-off portion 46 according to an exemplary embodiment. The peel-off portion 46 is configured to be removed (e.g., separated, decoupled, detached, etc.) from the package 10 when the package 10 is transitioned from the closed position to the open position. Further, removal of the peel-off portion 46 helps ready the package 10 for the resealed position (see, e.g., FIG. 8). As will be discussed in more detail later, the peel-off portion 46 includes a first or removable portion 48 of the first wall panel 20 as well as a first portion 50 of the peel-reseal feature 24.

FIGS. 2A and 2B show a line of weakness 52 in the first wall panel 20 according to an exemplary embodiment. The line of weakness is configured to facilitate separation of the first portion 48 of the first wall panel 20 from a second portion 54 of the first wall panel 20. The line of weakness 52 is shown extending generally inward from the exterior surface 30 of the first wall panel 20, but not extending through to the interior surface 26 of the first wall panel 20. This configuration affords improved peeling control when opening the package 10 as well as the ability for the package 10 to be hermetically sealed in the closed position. The first portion 48 of the first all panel 20 is shown disposed generally above the line of weakness 52 and the second portion 54 of the first wall panel 20 is shown disposed generally below the line of weakness 52. As discussed above, the first portion 48 of the first wall panel 20 is removed from the package 10 as part of the peel-off portion 46 when the package 10 is transitioned from the closed position to the open position. The second portion 54 of the first wall panel 20 remains with the package 10 after the peel-off portion 46 is removed.

Referring to FIG. 1, separation of the first portion 48 of the first wall panel 20, and, relatedly, separation of the entire peel-off portion 46, is facilitated by a peel tab 56 according to an exemplary embodiment. The peel tab 56 is configured to be gripped (e.g., held, pinched, etc.) by a consumer while applying a peeling force. The peel tab 56 is shown as a portion of the first portion 48 of the first wall panel 20 that is not sealed to the second wall panel 22. In fact, as shown, the header 58 of package 10 is unsealed, thereby affording the peel tab 56. According to other exemplary embodiments, a peel tab may be any portion of a first wall panel at or above a top heat seal that is unsealed and thereby facilitates application of a peeling force to achieve separation of the peel-off portion. According to still other exemplary embodiments, a peel tab may be independent of the first wall panel and second wall panel, but coupled thereto. According to still other exemplary embodiments, one of the first side seal and the second side seal may be recessed in relative to an outer side edge of the package to afford a peel tab.

The side heat seals 36, 38 are shown extending at least to the bottom of the peel-reseal feature 24, but not extending above the top of the peel-reseal feature to help ensure the package 10 is peelable according to an exemplary embodiment. More specifically, FIG. 1 shows the side heat seals 36, 38 extending to the top of the peel-reseal feature 24. If the side heat seals 36, 38 were to extend above the peel-reseal feature 24, a fusion seal may result between the first wall panel and the second wall panel and cause a "lock-up" that would render the package not readily peelable.

Referring to FIGS. 2A and 2B, the peel-reseal feature 24 includes a first panel that is heat-sealable, shown as a skin panel 60, a second panel that is heat-sealable, shown as a bulk panel 62, and a pressure sensitive adhesive 64 according to an exemplary embodiment. The pressure sensitive adhesive 64 is shown disposed substantially between and coupled to each of the skin panel 60 and the bulk panel 62. For ease of manufacture and other functional considerations, the peel-reseal feature is a continuous strip (as shown). According to other exemplary embodiments, however, the peel-reseal feature may not be continuous. In such exemplary embodiments, the package may include additional features to provide for the package to be sufficiently (e.g., hermetically) sealed (e.g., an additional heat seal disposed above the peel-reseal feature that is capable of being removed (e.g., torn off transversely) before applying a peeling force to transition the package from the closed position to the open position).

According to an exemplary embodiment, the peel-reseal feature 24 is a discrete element that is formed before and independent of formation of the package 10. Having a peel-reseal feature that is formed before and independent of the package provides for the peel-reseal feature to be introduced into the package manufacturing process as a discrete element. Desirably, this can simplify the manufacturing process for the package. For example, one can more readily substitute one configuration of the peel-reseal feature for another, different peel-reseal feature in the package manufacturing process. According to other exemplary embodiments, the peel-reseal feature is partially formed during the package manufacturing process. According to still other exemplary embodiments, the peel-reseal feature can be formed during the package manufacturing process.

Figure 3A:
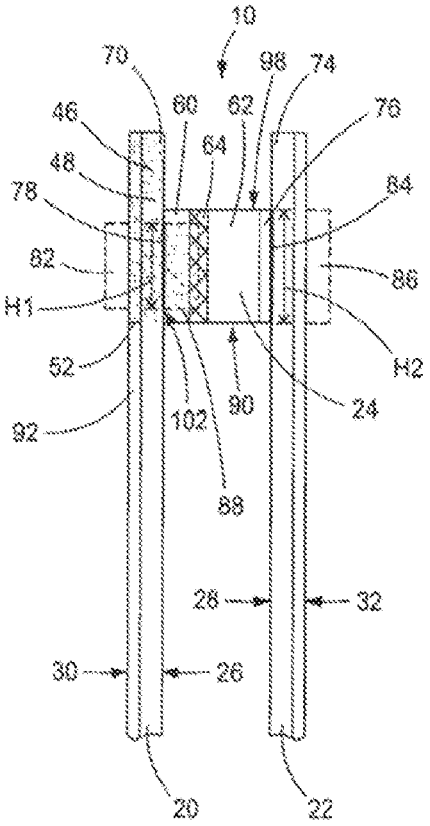
FIG. 3A is a detail, cross-sectional view of a package in a closed position according to an exemplary embodiment.

Referring to FIG. 3A, the peel-reseal feature 24 is coupled to the wall panels 20, 22 when the package 10 is in the closed position according to an exemplary embodiment.

FIG. 3A shows skin panel 60 as a skin layer coupled to an interior layer 70 of first wall panel 20 at interior surface 26 according to an exemplary embodiment. The skin panel 60 is configured to fail (e.g., tear, rip, etc.) when the package 10 is transitioned from the closed position to the open position. Moreover, the interface between the skin panel 60 and the wall panel to which it is originally coupled in the closed position, shown here as first wall panel 20, is configured to provide a preferential peelable interface when initiating the transition from the closed position to the open position (see FIG. 3B) by application of a peeling force by a consumer. According to one exemplary embodiment, the skin layer is polyethylene, which affords beneficial tear properties and is well-suited for heat sealing to the interior layer 70 of the first wall panel 20, as will be discussed in more detail below. According to other exemplary embodiments, the skin panel may include two or more layers so long as the skin panel is heat sealable and configured to tear when transitioning from the closed position to the open position.

Figure 3B:
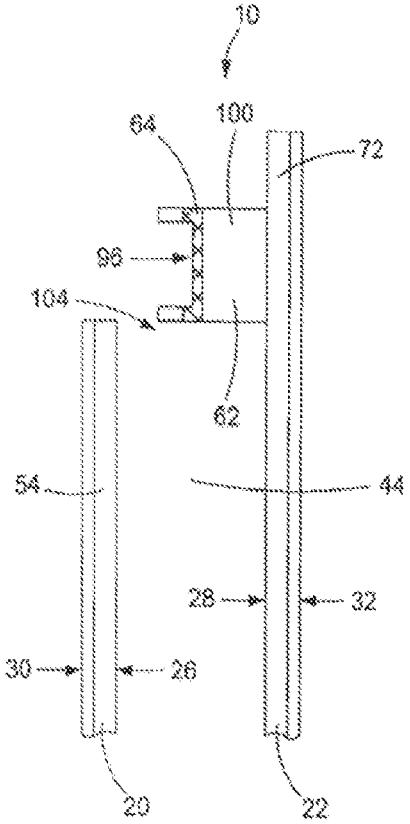
FIG. 3B is a detail, cross-sectional view of the package in an open position according to the exemplary embodiment of FIG. 3A.

FIG. 3A also shows bulk panel 62 coupled to the second wall panel 22 at the interior surface 28 of the second wall panel 22 according to an exemplary embodiment. The bulk panel 62 is configured to remain intact (e.g., not tear or otherwise fail) when the package 10 is transitioned from the closed position to the open position (see FIG. 3B illustrating the bulk panel intact in the open position). Moreover, the bulk panel 62 is configured to remain coupled to the wall panel to which it is originally coupled in the closed position (see FIG. 3A) in both the open position (see FIG. 3B) and the resealed position (see FIG. 3C). The portion of the second wall panel 22 to which the bulk panel 62 remains coupled in the open position and the resealed position corresponds to a flap 72 that is substantially defined by the removal of the peel-off portion 46. According to one exemplary embodiment, the bulk panel 62 includes two or more layers, at least one of which is an exterior layer 76 that is heat sealable to an interior layer 74 of the second wall panel 22 According to one exemplary embodiment, the bulk panel 62 includes two or more layers and the skin panel 60 includes one layer. Generally the bulk panel 62 includes more layers than the skin panel; that being said, the relative bulk of the panels is more significant than the number of layers.

Figure 3C:
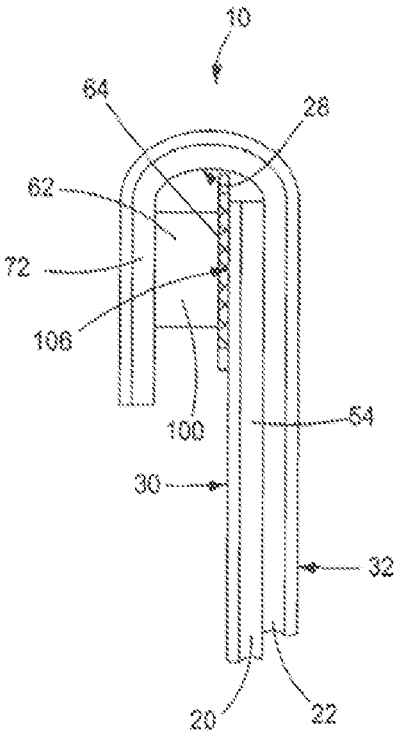
FIG. 3C is a detail, cross-sectional view of the package in a resealed position according to the exemplary embodiment of FIG. 3A.
Figure 3D:
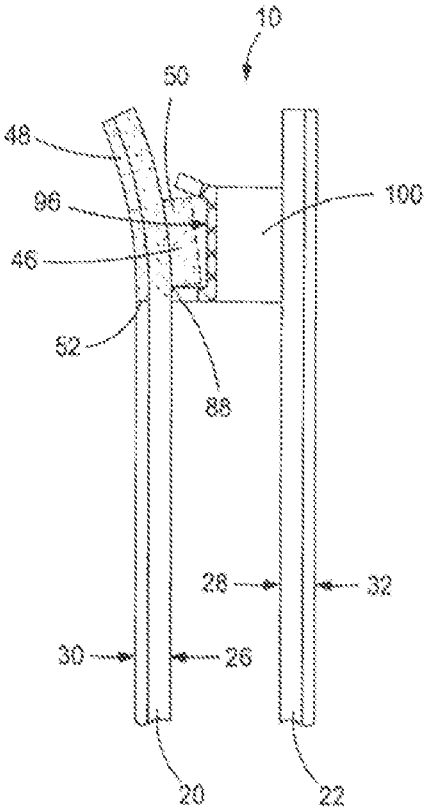
FIG. 3D is a detail, cross-sectional view of the package transitioning from the closed position to the open position according to the exemplary embodiment of FIG. 3A.
Figure 4A:
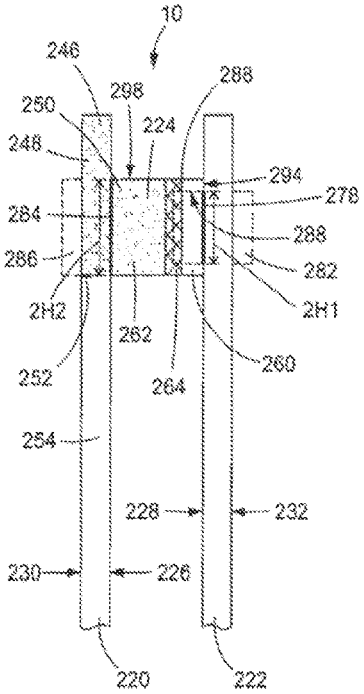
FIG. 4A is a detail, cross-sectional view of a package in a closed position according to another exemplary embodiment.
Figure 4B:
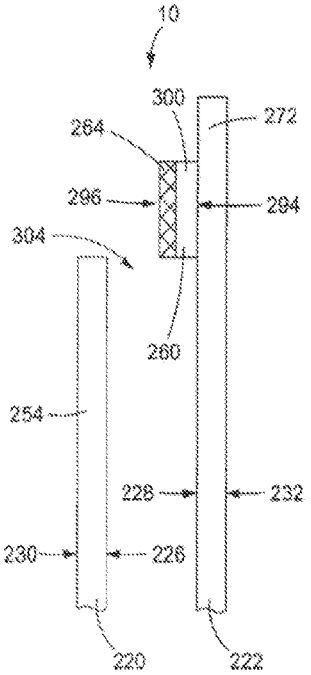
FIG. 4B is a detail, cross-sectional view of the package in an open position according to the exemplary embodiment of FIG. 4A.
Figure 4C:
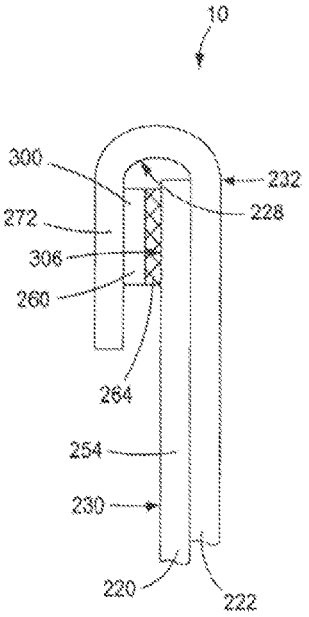
FIG. 4C is a detail, cross-sectional view of the package in a resealed position according to the exemplary embodiment of FIG. 4A.

According to other exemplary embodiments, the bulk panel may be included in the peel-off portion (compare FIGS. 4A-4C to, for example, FIGS. 3A-3D). It should be noted, however, even when the bulk panel is included in the peel-off portion, the bulk panel remains intact and coupled to the wall panel portion to which it is originally coupled (see, e,g, the exemplary embodiment of FIGS. 4A-4C).

In the exemplary embodiment shown in FIG. 3A, the interior layer 70 of the first wall panel 20, the skin panel 60, the interior layer 74 of the second wall panel 22, and the exterior layer 76 of the bulk panel 62 are all polyethylene, which provides beneficial heat sealing characteristics. According to other exemplary embodiments, the materials of interior layers of the wall panels may differ and/or the material of exterior layers of the panels of the peel-reseal feature may differ so long as the interfacing materials are well-suited for heat sealing to one another Generally, an interior layer of the first wall panel is a material that is well suited for heat sealing to an exterior layer of a skin panel of a peel-reseal feature. Also, generally, an interior layer of a second wall panel is a material that heat seals well to an exterior layer of the bulk panel.

Referring further to FIG. 3A, the heat seals coupling the peel-reseal feature 24 to the wall panels 20, 22 are shown according to an exemplary embodiment. For ease of explanation and clarity, the approximate positions of the corresponding heat seal bars or plates that form the heat seals (during manufacture) are also shown (in dashed lines). A first or skin panel heat seal 78 is shown coupling the skin panel 60 to the first wall panel 20. The first heat seal 78 extends generally a first height H1 (as measured from top-to-bottom) at the interface of the skin panel 60 and the first wall panel 20. The first height H1 substantially corresponds to the height of a first heat seal bar 82, which provides for heat sealing the skin panel 60 to the first wall panel 20 during the manufacturing process. A second or bulk panel heat seal 84 is shown coupling the bulk panel 62 to the interior surface 28 of the second wall panel 22. The second heat seal 84 extends generally a second height H2 (as measured from top-to-bottom) at the interface of the bulk panel 62 and the second wall panel 22. The second height H2 substantially corresponds to the height of a second heat seal bar 86, which provides for heat sealing the skin bulk panel 62 to the second wall panel during the manufacturing process. As will be discussed in more detail later, the first heat seal 78 is generally shorter (or narrower) than the second heat seal 84, helping provide for the interface between the skin panel 60 and the first wall panel 20 to be the preferential peelable interface.

Referring back to FIG. 1, the first heat seal 78 (shown in FIG. 3A) and second heat seal 84 (shown in FIG. 3A) collectively form the top heat seal 34 according to an exemplary embodiment. Accordingly, the top end 12 of the package 10 is sealed closed along with the peel-reseal feature 24 being coupled to both of the first and second wall panels during the manufacturing process. According to one exemplary embodiment, formation of the first heat seal 78 provides for completion of coupling the peel-reseal feature to the corresponding wall panel as well as sealing closed the package. According to other exemplary embodiments, additional heat seals, heat sealing steps, and/or other methods suitable for closing a flexible package may be used in combination with the first and second heat seals to couple the peel-reseal feature to the side panels and close the package during manufacture.

Referring to FIG. 3A, the line of weakness 52 is shown disposed at or below the bottom end of the first heat seal 78 according to an exemplary embodiment. In this position, the line of weakness 52 is encountered essentially at the end of a failure path 88 (as it progresses generally from top to bottom) for separating the peel-off portion 46 (designated in a dotted crosshatch for clarity) from the package 10. Once encountered, the line of weakness 52 directs peeling generally therealong in the side-to-side (or transverse) direction, helping to achieve a controlled separation of the peel-off portion 46 as the consumer continues to apply the peeling force (discussed in more detail later in this disclosure). It should be noted that the present discussion highlights the functionality of the line of weakness when there is standard application of a generally transverse, outward and top-to-bottom style peeling force by a consumer (based on the orientation of the package as shown in the FIGURES). A consumer may vary the application of a peeling force, such that the progression of failure path varies. It should also be noted that the heat seals, the failure path and more generally the separation of the peel-off portion is presented in a manner that facilitates description, but, in practice, will have greater variability (e.g., the pressure sensitive adhesive fails cohesively, but not likely in a perfectly vertical line).

The line of weakness 52 is further shown disposed at or above a bottom side 90 of the peel-reseal feature 24 according to an exemplary embodiment. Stated otherwise, the line of weakness 52 is shown generally aligned with a bottom portion of the skin panel 60 of the peel-reseal feature 24 that is not heat sealed to the first wall panel 20. This positioning helps provide a smooth, more controlled progression of the failure path 88 back outward through the first wall panel 20 to the line of weakness 52 when removing the peel-off portion 46. Further, this positioning helps ensure sufficient reseal surface is available by avoiding removal of a too large portion of the first wall panel during transition from the closed position to the open position. Further still, this location can help achieve a more air tight resealed position by avoiding a big space between the top edge of the second portion of the first wall panel and the reseal surface.

Referring generally to the FIGURES, it is preferred that the line of weakness 52 extend inward from the exterior surface 30 of the first wall panel 20 but not extend through to the interior surface 26 of the first wall panel 20, as shown in FIG. 3A. This configuration affords the benefits of controlled peeling and facilitates separation of the first portion 48 from the second portion 54 of the first wall panel 20, while still allowing for a package that is hermetic. That being said, for some applications, the package need not be hermetic.

FIG. 3A shows the line of weakness 52 extending through an exterior layer 92 of first wall panel 20 but not extending through any other layers of the first wall panel 20 according to an exemplary embodiment. According to some exemplary embodiments, the line of weakness does not extend through at least an interior layer 70 of the first wall panel 20, but does extend through more than just the exterior layer 92 of the first wall panel 20. The first wall panel 20 may have any number of layers so long as it is still suitable for use in flexible packaging (e.g., 5, 6, 7, 8, 9, 10, 11, etc.). Accordingly, the line of weakness may extend into/through many layers of the first wall panel in other exemplary embodiments. According to still other exemplary embodiments, the line of weakness may extend into, but not through, the exterior layer of the first wall panel so long as the line of weakness is sufficient to provide improved peeling control and facilitate separation of the peel-off portion.

According to an exemplary embodiment, the line of weakness 52 is formed mechanically. For example, a blade or other cutting instrument may be used to mechanically separate or remove material from a wall panel to form a generally linear absence of material (e.g., depression, cavity, concavity, pit, indentation, slit, etc.). According to another exemplary embodiment, the line of weakness may be formed using optical means (e.g., a laser). Moreover, while the line of weakness 52 is shown as a substantially continuous line, a line of weakness may be intermittent (e.g., substantially defined by intermittent absences of material suitable to provide a general line or path of weakness that provides for improved peeling control).

FIGS. 3A-3C show the first wall panel 20 having at least two layers, the interior layer 70 and the exterior layer 92, according to an exemplary embodiment. As discussed above, the interior layer 70 is a material heat sealable to the skin panel 60 of the peel-reseal feature 24. According to one exemplary embodiment, the interior layer 70 is polyethylene. The exterior layer 92 is a material well suited for adhering the pressure sensitive adhesive 64 thereto in the reseal position. According to one exemplary embodiment, the exterior layer 92 is oriented polyethylene terephthalate (hereafter "OPET"). An exterior layer that is OPET also provides manufacturing benefits. For instance, OPET does not seal to itself during the manufacturing process. Also, OPET is relatively tear resistant: this helps prevent unintentional tearing (e.g., tearing not along the line of weakness).

Referring to FIGS. 3A-3D, the second wall panel 22 has the same structure as the first wall panel 20 according to an exemplary embodiment. According to other exemplary embodiments, this need not be the case. For example, the number of layers of each wall panel may differ and/or the materials of each layer may differ. In fact, the materials for each layer can vary significantly so long as the resultant wall is well-suited for use in flexible packaging and the interior and exterior layers provide the functionalities described above.

According to some exemplary embodiments, the wall panels may have barrier properties. In some exemplary embodiments, each wall panel includes one or more layers that is/includes a barrier material. The barrier materials may be selected based on the intended use of the package. For instance, a package intended for use with a moisture-sensitive product may include a barrier material that provides a water vapor barrier.

According to some exemplary embodiments, one or both wall panels include one or more paper layers. According to some exemplary embodiments, one or both wall panels include one or more non-woven layers.

Referring further to FIGS. 3A-3D, the positioning of the skin panel 60 and bulk panel 62 of the peel-reseal feature 24 as well as the configuration of the heat seals coupling the peel-reseal feature to the wall panels helps provide a preferential peelable interface according to an exemplary embodiment.

According to the exemplary embodiment shown, the preferential peelable interface is between the interior surface 26 of the first wall panel 20 and an exterior surface 94 (shown in FIG. 2B) of the skin panel 60 of the peel-reseal feature 24. Mien a consumer begins to apply a peeling force to the peel tab 56, the peel-off portion 46 is configured to begin to separate from the remainder of the package 10 at this interface. Initiation of the separation at the preferential peelable interface is further configured to facilitate separation of the peel-off portion 46 along a desired failure path, shown as failure path 88, thereby creating a desirable separation interface, shown generally as separation interface 96 (see FIG. 3B illustrating separation interface 96, which is exaggerated for ease of explanation and clarity).

Referring to FIGS. 3A and 3B, the second height H2 of the second heat seal 84 is shown greater (or broader) than the first height H1 of the first heat seal 78 according to an exemplary embodiment. The second heat seal 84 is further shown extending substantially the entire height of the peel-reseal feature 24. This configuration helps the bulk panel 62 remain coupled to the wall panel to which it is originally coupled in the closed position, shown here as second wall panel 22. The greater bulk of the bulk panel 62 also contributes to the bulk panel 62 remaining intact and coupled to the second wall panel 22 while the thinner, skin panel 60 provides one side of the preferential peelable interface and fails when transitioning from the closed position to the open position. According to other exemplary embodiments, all of these characteristics need not be present, just some combination in sufficient amount that the bulk layer does not fail and substantially remains coupled to the wall panel to which it is initially coupled in the closed position while the skin layer is involved in the preferential peelable interface. For example, in another exemplary embodiment, the first heat seal and the second heat seal may have the same height.

Referring to FIGS. 3A-3B and 3D, the first height H1 of first heat seal 78 is less than the second height H2 of the second heat seal 84 and also is spaced a distance below a top surface 98 (shown in FIG. 26) of the peel-reseal feature 24 according to an exemplary embodiment. Thus, an upper portion of the skin panel 60 is not sealed to the first wall panel 20, thereby helping provide for removal of the peel-off portion 46 to initiate at the preferential peelable interface between the exterior surface 94 (shown in FIG. 2B) of the skin panel 60 of peel-reseal feature 24 and the interior surface 26 of the first wall panel 20. Having a preferential peelable interface helps achieve the desired failure path and avoid peeling at less desirable interfaces. Peeling at less desirable interfaces can be particularly problematic as it might compromise the reseal functionality of the package. For example, separation may occur at an interface whereat separation does not sufficiently expose the pressure sensitive adhesive after the package 10 is transitioned from the closed position to the open position.

Referring generally to FIGS. 3A-3D, upon application of a peeling force by a consumer, the peel-off portion 46 is separated from the package 10 to transition the package 10 from the closed position to the open position according to an exemplary embodiment. The peel-off portion 46 includes the first portion 48 of the first wall panel 20 and the first portion 50 of the peel-reseal feature 24. A second portion 100 of the peel-reseal feature 24 remains coupled to the flap 72 of the second wall panel 22 after the peel-off portion 46 has been removed. In the open position, an opening is provided and pressure sensitive adhesive 64 of the second portion 100 is exposed, providing for resealability when the package 10 is transitioned from the open position to the resealed position. In the resealed position, the pressure sensitive adhesive 64 is engaged with the exterior surface 30 of the second portion 100 of the first wall panel 20. Application of a peeling force may then be used to transition the package back to the open position. Repeated transitioning between the open position and resealed position is thereafter possible in a similar manner.

More specifically addressing the transition from the closed position to the open position illustrated in FIGS. 3A-3B and 3D according to an exemplary embodiment, with application of a generally transverse has shown, the first side 16 toward the second side 18), downward (according to the orientation shown), and outward (away from the exterior surface 30 of the first wall panel 20) peeling force (e.g., via peel tab 56), the failure path 88 originates at the preferential peelable interface between the exterior surface 94 of the skin panel 60 of the peel-reseal feature 24 and the interior surface 26 of the first wall panel 20 until encountering the first heat seal 78. As the peeling force continues to be applied, the skin panel 60 begins to fail. The skin panel 60 tears generally inward toward the pressure sensitive adhesive 64, as generally indicated by failure path 88. The pressure sensitive adhesive 64 is configured to fail cohesively according to the present exemplary embodiment. Moreover, the bond strength of the heat seals 78, 84 is generally greater than the peel force needed for the pressure sensitive adhesive 64 to fail cohesively. Thus, continued application of the peeling force extends the failure path 88 into the pressure sensitive adhesive 64 until the pressure sensitive adhesive 64 fails, essentially splitting the pressure sensitive adhesive 64 in the top-to-bottom direction. This splitting occurs substantially until the failure path 88 generally corresponds with a bottom edge 102 of the first heat seal 78, after which continued application of the peeling force seeks the path of least resistance, bringing the failure path 88 back from the pressure sensitive adhesive 64, through the skin panel 60, to the interface of the skin panel 60 and the first wall panel 20. The failure path 88 then continues through the first wall panel 20 until encountering the line of weakness 52, creating a separation point between the first portion 48 and the second portion 54 of the first wall panel 20.

Referring to FIG. 3D and FIG. 9, continued application of the peeling force transversely progresses the above-described failure process until finally separating the peel-off portion 46 according to an exemplary embodiment. Separation of the peel-off portion 46 thereby removes the first portion 48 of the first wall panel 20 and the first portion 50 of the peel-reseal feature 24 from the package 10. As shown in FIG. 3D, the first portion 50 of the peel-reseal feature 24 includes a portion of the skin panel 60 and a portion of the pressure sensitive adhesive 64.

According to an exemplary embodiment, removal of the peel-off portion 46 further provides tamper evidence. Some pressure sensitive adhesives experience whitening in color upon failure. This whitening is typically more significant when the failure is cohesive failure. Thus, as the peel-off portion is removed, the pressure sensitive adhesive fails cohesively and transitions to a whiter color. This transition can serve as a valuable visual indicator to consumers.

Now in the open position, FIG. 3B shows the pressure sensitive adhesive 64 exposed and an opening 104 to the cavity 44 of the package 10 provided according to an exemplary embodiment The second portion 100 of the peel-reseal feature 24 remains after opening; this second portion 100 includes the exposed pressure sensitive adhesive 64 as well as the bulk panel 62. The second portion 100 of the peel-reseal feature 24 is shown coupled to the second wall panel 22 at the flap 72, providing for the second portion 100 to be movable therewith.

Referring to FIGS. 3B and 3C, the package 10 may be transitioned from the open position (FIG. 3B) to the resealed position (FIG. 3C) by folding the flap 72 over the second portion 54 of the first wall panel 20 to bring the pressure sensitive adhesive 64 into engagement with the exterior surface 30 of the first wall panel 20 according to an exemplary embodiment. The consumer may also apply pressure to the second wall panel 22 at/along the length (or a portion of the length) of the pressure sensitive adhesive 64 to help ensure a strong and consistent reseal.

According to an exemplary embodiment, the exterior surface 30 of the first wall panel 20 is corona treated. The corona treatment creates a higher surface energy, affording a better affinity between the pressure sensitive adhesive and the exterior surface 30 of the first wall panel 20. The resultant increased adhesion provides a stronger reseal than when the exterior surface of the first wall panel is not corona treated.

Referring to FIG. 3C, the area of the exterior surface 30 to which the pressure sensitive adhesive 64 is adhered is generally referred to as the reseal surface 106 according to an exemplary embodiment. The location of the reseal surface 106 may change depending on the manner in which the flap 72 is folded over to reseal the package 10. In fact, the location of the reseal surface may be at substantially any location on the exterior surface 30 of the first wall panel 20. For example, the consumer may fold over the flap 72 as shown in FIG. 3C such that only the flap 72 of the second wall panel 22 is folded over. According to other exemplary embodiments, a portion of the first wall panel and an additional portion of the second wall panel may be folded over along with the flap when resealing the package. With this manner of resealing, the reseal surface will be proximate the bottom end of the package relative to the reseal surface 106 as shown in FIG. 3C. This manner of resealing may be desirable based on the volume/amount of the remaining product and/or for expelling air when resealing the package. Thus, the package 10 of this disclosure provides for beneficial flexibility in the manner of reseal.

FIG. 3C may be transitioned from the reseal position back to the open position of FIG. 3B by again applying a peeling force (e.g., generally upward). Repeated transition between the open position and the resealed position is possible while maintaining a sufficient seal between the pressure sensitive adhesive and the exterior surface of the first wall panel in the reseal position.

The package 10 of this disclosure is configured to be manufactured efficiently. For the purposes of the following discussion, manufacture of the package 10 will be discussed in reference to the exemplary embodiment shown in FIGS. 3A-3D.

Referring to FIGS. 3A-3D, the peel-reseal feature 24 is a discrete element that is manufactured in advance of the package manufacturing process according to an exemplary embodiment. Manufacturing the peel-reseal feature 24 in advance reduces the complexity of the package manufacturing process. Not only are there fewer steps in the package manufacturing process, but also those steps required for coupling the peel-reseal feature to the wall panels are simpler, as will be discussed in more detail below. According to the present exemplary embodiment, the peel-reseal feature is manufactured using a coextrusion process. The peel-reseal features of the exemplary embodiments shown in FIGS. 2A-5C are shown manufactured using a coextrusion process. For those exemplary embodiments of a package including a laminated peel-reseal feature (e.g., the exemplary embodiment shown in FIGS. 6A-6C), a lamination process will be used to manufacture the peel-reseal feature.

A roll of film that will serve as the wall panels (hereafter "wall panel film") as well as a roll or spool of the peel-reseal feature material are provided at the beginning of the package manufacturing process according to an exemplary embodiment. This wall panel film and the peel-reseal feature material are placed on separate unwinds of a packaging machine. The wall panel film is slit to create the first wall panel and second wall panel (which may be referred to as a front panel and back panel during the manufacturing process due to their orientation during manufacture). The peel-reseal feature material is then fed between the first wall panel and the second wall panel. At a first heat seal station, one side of the peel-reseal feature material is heat sealed to an interior surface of the corresponding wall panel. Referring specifically to the elements of the exemplary embodiment shown in FIGS. 3A-3D, the bulk panel 62 is coupled to the interior surface 28 of the second wall panel 22 at this first heat seal station. The resultant heat seal is the second or bulk panel heat seal 84. This second heat seal 84 is shown having a height substantially corresponding to the height of the peel-reseal feature 24. According to other exemplary embodiments, the heat seal formed at the first heat sealing station may be shorter (narrower) than the peel-reseal feature. According to still other exemplary embodiments, the heat seal formed at the first heat sealing session may be taller (broader) than the peel-reseal feature; such a configuration typically requires use of Teflon or another nonstick material that prevents the wall panels from being heat sealed directly together.

The peel-reseal feature material and the wall panels travel together to a second heat seal station according to an exemplary embodiment. At the second heat seal station, the side and bottom seals of the package 10 are formed. The first or skin panel heat seal 78 couples the skin panel 60 to the first wall panel. The first seal 78 is preferably made the same height or slightly narrower than the second heat seal 84 described above. After the second heat sealing station, the packages are separated from one another by cutting the side seals proximate their centers.

According to another exemplary embodiment, the side and bottom seals of the package are formed at the second heat seal station. Subsequently, the packages are separated from one another by cutting the side seals proximate their centers. The packages in this format may then be sent out for filling and heat sealing closed (i.e., by forming the first heat seal 78 to couple the skin panel 60 to the first wall panel).

According to another exemplary embodiment, the package is filled after the side and bottom heat seals of the package are formed at the second heat seal station. Subsequently, at a third heat seal station, the other side of the peel-reseal feature material is heat sealed to the corresponding wall panel. Referring specifically to the elements of the exemplary embodiment shown in FIGS. 3A-3D, the skin panel 60 is heat sealed to the interior surface 26 of the first wall panel 20 at this third heat seal station. The resultant heat seal is the first or skin panel heat seal 78. This first heat seal 78 is shown narrower than the second heat seal 84. According to other exemplary embodiments, this first heat seal may be narrower than it is shown, so long as it is sufficient to bond the peel-reseal feature to the first wall panel and to close the package. According to still other exemplary embodiments, the first heat seal may be taller (or broader) than it is shown. That being said, to avoid fusion seals that complicate opening the resultant package, potentially rendering it unpeelable, the first heat seal 78 is disposed at or above the line of weakness 52 and is not broader than the side of the peel-reseal feature that is heat sealed to its corresponding wall panel at the third heat seal station (here, the skin panel 60 side of the peel-reseal feature 24). According to an alternative exemplary embodiment, the side seals and the first heat seal are formed at the second heat seal station, the package is filled, and, finally, the bottom heat seal is formed at a third heat seal station.

The above-described manufacturing process may be modified so long as it remains suitable for forming a package according to this disclosure. Moreover, other exemplary manufacturing processes may be used (e.g., to manufacture other package styles, a horizontal form fill seal process, a vertical form fill seal process, etc.) that allow for feeding in of the peel-reseal feature as a discrete element as well as for heat sealing the peel-reseal feature material to the wall panels and, by the same, sealing the package closed. According to still other exemplary manufacturing processes, the peel-reseal feature may be formed in whole or in part during the package manufacturing process, but such manufacturing processes are not preferred.

According to an exemplary embodiment, the line of weakness is created before the package manufacture process as described above. The wall panel film is utilized in the manufacturing process in a form already including the line of weakness. Like the manufacturing of the peel-reseal feature 24, creating the line of weakness in the wall panel film in advance reduces the complexity of the package manufacturing process. The line of weakness may be formed as part of or after the film forming process. In some exemplary embodiments, the line of weakness is formed during the package manufacturing process. Other exemplary embodiments of forming the line of weakness are discussed in more detail above.

FIGS. 4A-4C show package 10 according to another exemplary embodiment. As will be discussed below, the exemplary embodiment of FIGS. 4A-4C is shown including the same component elements as the exemplary embodiment of FIGS. 3A-3D, but the configuration of these elements differs.

FIGS. 4A-4C illustrate an exemplary embodiment of a package 10 that is a flexible package including a first wall panel 220 generally opposite a second wall panel 222, and a peel-reseal feature 224 that extends transversely substantially the width of the package 10 from the first side 16 to the second side 18. The first wall panel 220 and the second wall panel 222 are polymeric webs that each includes an interior surface 226, 228 and an exterior surface 230, 232, respectively. The first wall panel 220 and the second wall panel 222 are heat sealed together, the top heat seal 34 (shown in FIG. 1) coupling the peel-reseal feature 224 between the wall panels 220, 222 in addition to coupling the wall panels 220. 222 together at the top end 12 to close the package 10.

Referring in particular to FIG. 4A, the peel-reseal feature 224 includes a first panel that is heat-sealable, shown as a skin panel 260, a second panel that is heat-sealable, shown as a bulk panel 262, and a pressure sensitive adhesive 264 disposed between the skin panel 260 and the bulk panel 262 according to an exemplary embodiment. Like peel-reseal feature 24, the skin panel 260 of peel-reseal feature 224 is configured to fail, the bulk panel is configured to remain intact, and the pressure sensitive adhesive 264 is configured to fail cohesively when the package 10 is transitioned from the closed position to the open position. The orientation (e.g., positioning, disposition, structure, etc.) of peel-reseal feature 224 relative to the wall panels 220, 222 does, however, differ from peel-reseal feature 24. Also, while the heat seal with the greater height is still shown to correspond to the location of the bulk panel 262, the different orientation of the peel-reseal feature 224 results in this taller (broader) heat seal being in a different position relative to the wall panels. As will be discussed in more detail below, these differences do not impact the method of using the package 10 (e.g., basic peel-reseal functionality) for the consumer. These positioning difference do, however, impact the failure path that provides for a peel-off portion 246 to be removed from the package when transitioning from the closed position to the open position as well as impact the peel-off portion 246 itself.

Referring to FIGS. 4A-4C, the peel-reseal feature 224 of the present exemplary embodiment is shown rotated 180 degrees about its transverse axis relative to the peel-reseal feature 24 of the exemplary embodiment in FIGS. 3A-3D according to an exemplary embodiment.

FIG. 4A shows the bulk panel 262 coupled to the first wall panel 220 at a first portion 248 of the first wall panel 220 located generally above a second portion 254 of the first wall panel 220 and generally above a line of weakness 252 according to an exemplary embodiment. Similar to the exemplary embodiment of FIGS. 3A-3D, the bulk panel 262 is configured to remain coupled to the wall panel to which it is originally coupled in the closed position, here first wall panel 220 at the first portion 248. Unlike the exemplary embodiment of FIGS. 3A-3D, however, the bulk panel 262 is removed from the package 10 as part of the peel-off portion 246 when the package 10 is transitioned from the closed position to the open position. A second or bulk panel heat seal 284 couples the bulk panel 262 to the first wall panel 220. Similar to the second heat seal 84, the second heat seal 284 extends a height 2H2 that substantially corresponds to the height of a heat seal bar 286 (shown in dashed lines for clarity) and the height of the peel-reseal feature 224. These heat seal characteristics, along with the greater bulk of the bulk panel 262 relative to the skin panel 260, are configured to help the bulk panel 262 remain coupled to the first portion of the first wall panel 220 when the peel-off portion 246 is removed. The greater bulk of the bulk panel 262 also contributes to the bulk panel 262 remaining intact while the thinner, skin panel 260 fails when transitioning from the closed position to the open position.

FIG. 4A also shows the skin panel 260 coupled to the second wall panel 222 by a first or skin panel heat seal 278 according to an exemplary embodiment. Similar to the exemplary embodiment of FIGS. 3A-3D, the skin panel 260 and the wall to which it is originally coupled in the closed position are configured to help provide a preferential peelable interface when transitioning from the closed position to the open position. In this exemplary embodiment, the preferential peelable interface initiates between the skin panel 260 and the second wall panel 222. The first heat seal 278 has a first height 2H1 substantially corresponding to the height of a heat seal bar 282. The first heat seal 278 starts a distance below the top surface 298 (in the orientation shown in the FIGS. 4A-4C) of the peel reseal feature 224, thereby helping ensure that the peeling off of the peel-off portion 246 initiates at the top of the preferential peelable interface of the skin panel 260 and the wall panel to which it is originally coupled, here the second wall panel 222.

As with the exemplary embodiment of FIGS. 3A-3D, upon application of a peeling force to the exemplary embodiment of FIGS. 4A-4C, the peel-off portion 246 is separated from the package 10 to transition the package 10 from the closed position to the open position according to an exemplary embodiment. The peel-off portion 246 includes the first portion 248 of the first wall panel 220 and a first portion 250 of the peel-reseal feature 224. A second portion 300 of the peel-reseal feature 224 remains with the package 10 after the peel-off portion 246 has been removed. In the open position, pressure sensitive adhesive 264 of the second portion 300 is exposed, providing for resealability when the package 10 is transitioned from the open position to the resealed position. In the resealed position, the pressure sensitive adhesive 264 is engaged with the exterior surface 230 of the second portion 254 of the first wall panel 220. Application of a peeling force may then be used to transition the package back to the open position. Repeated transitioning between the open position and resealed position is thereafter possible in a similar manner.

More specifically addressing the transition from the closed position to the open position and the transition between the open position to the resealed position illustrated in FIGS. 4A-4C according to an exemplary embodiment, with application by a consumer of a generally transverse, outward and downward peeling force, a failure path 288 travels along the preferential peelable interface between an exterior surface 294 of the skin panel 260 of the peel-reseal feature and the interior surface 228 of the second wall panel 222. As the peeling force continues to be applied, the skin panel 260 begins to fail. The skin panel 260 tears generally inward toward the pressure sensitive adhesive 264, as generally indicated by a failure path 288. The pressure sensitive adhesive 264 is configured to fail cohesively. Moreover, the bond strength of the heat seals 278, 284 is generally greater than the peel force needed for the pressure sensitive adhesive 264 to fail cohesively. Thus, continued application of the peeling force extends the failure path 288 into the pressure sensitive adhesive 264 until the pressure sensitive adhesive 264 fails, essentially splitting the pressure sensitive adhesive 264 in the top-to-bottom direction. This splitting occurs substantially until the failure path 288 corresponds with the bottom edge of the first heat seal 278, after which continued application of the peeling force seeks the path of least resistance, bringing the failure path 288 back from the pressure sensitive adhesive 264, to the interface between the skin panel 260 and the second wall panel 222. At this interface, the skin panel 260 is not sealed to the second wall panel 222. Accordingly, the first portion 250 of the peel-reseal feature 224 moves away and creates a separation point from the second wall panel 222 and the peeling force acts directly on the first wall panel 220. The peeling force then causes the first portion 248 of the first wall panel 220 to begin to separate from the second portion 254 generally along the line of weakness 252.

Continued application of the peeling force transversely progresses the above-described failure process to eventually separating the peel-off portion 246 according to an exemplary embodiment. Separation of the peel-off portion 246 thereby removes the first portion 248 of the first wall panel 220 and the first portion 250 of the peel-reseal feature 224 from the package 10. As shown, the first portion 250 of the peel-reseal feature 224 includes the bulk panel 262 in addition to a portion of the pressure sensitive adhesive 264 and a portion of the skin panel 260. A resultant separation interface is shown as separation interface 296.

Now in the open position. FIG. 4B shows the pressure sensitive adhesive 264 exposed and an opening 304 to the cavity 44 of the package 10 provided according to an exemplary embodiment. The second portion 300 of the peel-reseal feature 224 remains, this second portion 300 shown including the exposed pressure sensitive adhesive 264 as well as a portion of the skin panel 260. As in the exemplary embodiment of FIGS. 3A-3D, the second portion 300 of the peel-reseal feature 224 is shown coupled to the second wall panel 222 at a flap 272, providing for the second portion 300 to be movable therewith.

Referring to FIGS. 4B and 4C, the package 10 may be transitioned from the open position (shown in FIG. 4B) to the resealed position (shown in FIG. 4C) by folding the flap 272 over the second portion 254 of the first wall panel 220 to bring the pressure sensitive adhesive 264 into engagement with the exterior surface 230 of the first wall panel 220 according to an exemplary embodiment. The consumer may also apply pressure to the second wall panel 222 at/along the length (or a portion of the length) of the pressure sensitive adhesive 264 to help ensure a strong and consistent reseal.

Referring to FIG. 4C, the area of the exterior surface to which the pressure sensitive adhesive 264 is adhered is generally referred to as the reseal surface 306 according to an exemplary embodiment. The location of the reseal surface 306 may change depending on the manner in which the flap 272 is folded over to reseal the package 10; in fact, the location of the reseal surface may be at substantially any location on the exterior surface 230 of the first wall panel 220. For example, the consumer may fold over the flap 272 as shown in FIG. 4C such that only the flap 272 of the second wall panel 222 is folded over. According to other exemplary embodiments, a portion of the first wall panel and an additional portion of the second wall panel may be folded over along with the flap when resealing the package. With this manner of sealing, the reseal surface will be proximate the bottom end of the package relative to the reseal surface 306 as shown in FIG. 4C. This manner of resealing may be desirable if there is less product remaining the package and/or if it is desirable to expel air when resealing the package. Thus, the package 10 of this disclosure provides for beneficial flexibility in the manner of reseal.

FIG. 4C may be transitioned from the reseal position back to the open position by again applying a peeling force (e.g., generally upward). Repeated transition between the open position and the reseal position is possible while maintaining sufficient seal strength between the pressure sensitive adhesive and the exterior surface of the first wall panel in the reseal position.

Figure 5A:
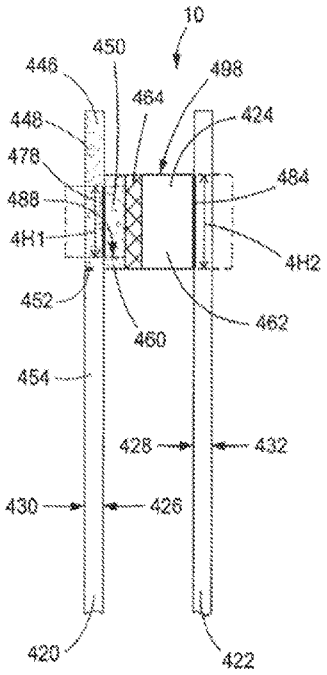
FIG. 5A is a detail, cross-sectional view of a package in a closed position according to another exemplary embodiment.
Figure 5B:
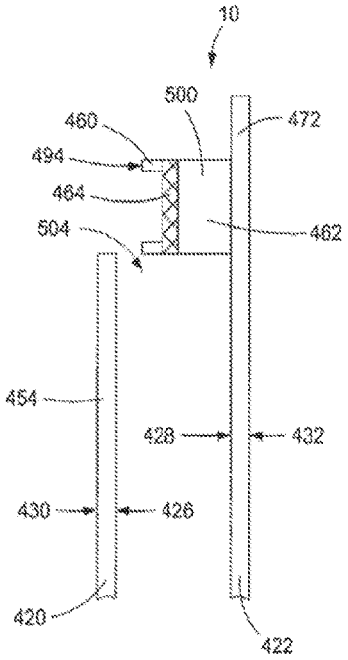
FIG. 5B is a detail, cross-sectional view of the package in an open position according to the exemplary embodiment of FIG. 5A.
Figure 5C:
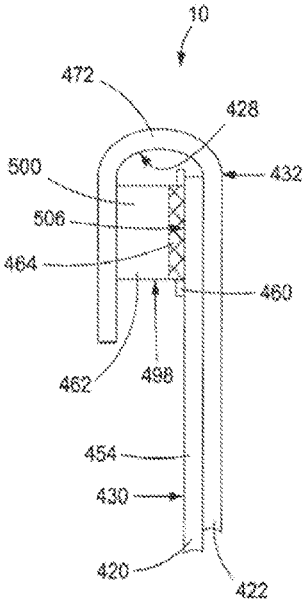
FIG. 5C is a detail, cross-sectional view of the package in a resealed position according to the exemplary embodiment of FIG. 5A.

FIGS. 5A-5C show package 10 according to another exemplary embodiment. In exemplary embodiment of FIGS. 5A-5C the pressure sensitive adhesive of its peel-reseal feature is configured to fail adhesively, rather than cohesively.

FIGS. 5A-5C illustrate an exemplary embodiment of a package 10 that is a flexible package including a first wall panel 420 generally opposite a second wall panel 422, and a peel-reseal feature 424 that extends substantially the width of the package 10 from the first side 16 to the second side 18. The first wall panel 420 and the second wall panel 422 are polymeric webs that each includes an interior surface 426, 428 and an exterior surface 430, 432, respectively. The first wall panel 420 and the second wall panel 422 are shown heat sealed together, the top heat seal 34 (shown in FIG. 1) coupling the peel-reseal feature 424 between the wall panels 420, 422 in addition to coupling the wall panels 420, 422 together at the top end 12 of the package 10.

Referring in particular to FIG. 5A the peel-reseal feature 424 includes a first panel that is heat-sealable, shown as a skin panel 460, a second panel that is heat-sealable, shown as a bulk panel 462, and a pressure sensitive adhesive 464 disposed between the skin panel 460 and the bulk panel 462 according to an exemplary embodiment. The skin panel 460 of peel-reseal feature 424 is coupled to the first wall panel 420 by a first or skin panel heat seal 478 and configured to fail. The bulk panel 462 of peel-reseal feature 424 is coupled to the second wall panel 422 by a second or bulk panel heat seal 484 and configured to remain in-tact. The pressure sensitive adhesive 464 is configured to fail adhesively when the package 10 is transitioned from the closed position to the open position. In this exemplary embodiment, utilizing a pressure sensitive adhesive configured to fail adhesively does not impact the method of using the package 10 (e.g., basic peel-reseal functionality) for the consumer. This pressure sensitive adhesive does, however, impact a failure path 488 that provides for a peel-off portion 446 to be removed from the package 10 when transitioning from the closed position to the open position. This pressure sensitive adhesive also impacts the peel-off portion 446 itself.

FIG. 5A shows the skin panel 460 coupled to the first wall panel 420 at a first portion 448 of the first wall panel 420 located generally above a second portion 454 of the first wall panel 420 and at or above a first line of weakness 452 according to an exemplary embodiment. Similar to the exemplary embodiments of FIGS. 3A-3D and FIGS. 4A-4C, the skin panel 460 and the wall panel to which it is originally coupled in the closed position are configured to help provide a preferential peelable interface when transitioning from the closed position to the open position. In this exemplary embodiment, the preferential peelable interface is between the skin panel 460 and the first wall panel 420. The first heat seal 478 is spaced a distance from the top surface 498 of the peel-reseal feature 424, thereby helping ensure that the peeling off of the peel-off portion 446 initiates proximate the top of the preferential peelable interface of the skin panel 460 and the wall panel to which it is originally coupled, here the first wall panel 420.

The bulk panel 462 is configured to remain coupled to the wall panel to which it is originally coupled in the closed position, the second wall panel 422, according to an exemplary embodiment. A height 4H2 of the second heat seal 484 coupling the bulk panel 462 to the second wall panel 422 is shown greater than the height 4H1 of a first heat seal 478 and also shown extending substantially the entire height of the peel-reseal feature 424. These heat seal characteristics and the greater bulk of the bulk panel 462 are configured to help the bulk panel 462 remain intact and coupled to the second wall panel 422 while the thinner, skin panel 460 fails when transitioning from the closed position to the open position.

Referring generally to FIGS. 5A-5C, upon application of a peeling force by a consumer, the peel-off portion 446 is separated from the package 10 to transition the package 10 from the closed position to the open position according to an exemplary embodiment. The peel-off portion 446 includes a first portion 448 of the first wall panel 420 and a first portion 450 of the peel-reseal feature 424. A second portion 500 of the peel-reseal feature 424 remains with the package 10 after the peel-off portion 446 has been removed. In the open position, the pressure sensitive adhesive 464 of the second portion 500 is exposed, providing for resealability when the package is transitioned from the open position to the resealed position. In the resealed position, the pressure sensitive adhesive 464 is engaged with the exterior surface 430 of the second portion 454 of the first wall panel 420. Application of a peeling force may then be used to transition the package 10 back to the open position. Repeated transitioning between the open position and the resealed position is thereafter possible in a similar manner.

More specifically addressing the transition from the closed position to the open position and the transition from the open position to the resealed position illustrated in FIGS. 5A-5C according to an exemplary embodiment, with application of a generally transverse, downward, and outward peeling force, the failure path 488 originates at the preferential peelable interface between the exterior surface 494 of the skin panel of the peel-reseal feature 424 and the interior surface 426 of the first wall panel 420 until encountering the first heat seal 478. As the peeling force continues to be applied, the skin panel 460 begins to fail. The skin panel 460 tears generally inward toward the pressure sensitive adhesive 464 and the pressure sensitive adhesive 464 begins to fail adhesively, the bond strength of the heat seals 478, 484 being generally greater than the peel force needed for the pressure sensitive adhesive 464 to fail adhesively. The failure path 488 is shown traveling substantially along the interface between the skin panel 460 and the pressure sensitive adhesive layer 464 as the peeling force continues to be applied. Proximate the bottom of the first heat seal 478, the failure path 488 travels generally outward towards the exterior surface 430 of the first wall panel 420 and eventually encounters the line of weakness 452 to separate the peel-off portion 446 from the package at that location.

Continued application of the peeling force transversely progresses the above-described failure process until finally separating the peel-off portion 446 according to an exemplary embodiment. Separation of the peel-off portion 446 thereby removes the first portion 448 of the first wall panel 420 and the first portion 450 of the peel-reseal feature 424 from the package 10. As shown, the first portion 450 of the peel-reseal feature 424 includes a portion the skin panel 460.

Now in the open position, FIG. 5B shows the pressure sensitive adhesive 464 exposed and an opening 504 to the cavity 44 of the package provided according to an exemplary embodiment. The second portion 500 of the peel-reseal feature 424 remains after opening, the second portion 500 shown including the exposed pressure sensitive adhesive 464, a portion of the skin panel 460, and the bulk panel 462. The second portion 500 of the peel-reseal feature 424 is shown coupled to the second wall panel 422 at a flap 472, providing for the second portion 500 to be movable therewith.

Referring to FIGS. 5B and 5C, the package 10 may be transitioned from the open position (FIG. 5B) to the resealed position (FIG. 5C) by folding the flap 472 over the second portion 454 of the first wall panel 420 to bring the pressure sensitive adhesive 464 into engagement with the exterior surface 430 of the first wall panel 420 according to an exemplary embodiment. The consumer may also apply pressure to the second wall panel 422 at/along the length for a portion of the length) of the pressure sensitive adhesive 464 to help ensure a strong and consistent reseal.

Referring to FIG. 5C, the area of the exterior surface to which the pressure sensitive adhesive 464 is adhered is generally referred to as the reseal surface 506 according to an exemplary embodiment. The location of the reseal surface 506 may change depending on the manner in which the flap 472 is folded over to reseal the package 10; in fact, the location of the reseal surface may be at substantially any location on the exterior surface 430 of the first wall panel 420. For example, the consumer may fold over the flap 472 as shown in FIG. 5C such that only the flap 472 of the second wall panel 422 is folded over. According to other exemplary embodiments, a portion of the first wall panel and an additional portion of the second wall panel may be folded over along with the flap when resealing the package. With this manner of sealing, the reseal surface will be proximate the bottom end of the package relative to the reseal surface 506 as shown in FIG. 5C. This manner of resealing may be desirable if there is less product remaining the package and/or if it is desirable to expel air when resealing the package. Thus, the package 10 of this disclosure provides for beneficial flexibility in the manner of reseal.

The package shown in FIG. 5C may be transitioned from the reseal position back to the open position of FIG. 5B by again applying a peeling force. Repeated transition between the open position and the resealed position is possible all while maintaining a sufficient seal between the pressure sensitive adhesive and the exterior surface of the first wall panel in the reseal position.

Figure 6A:
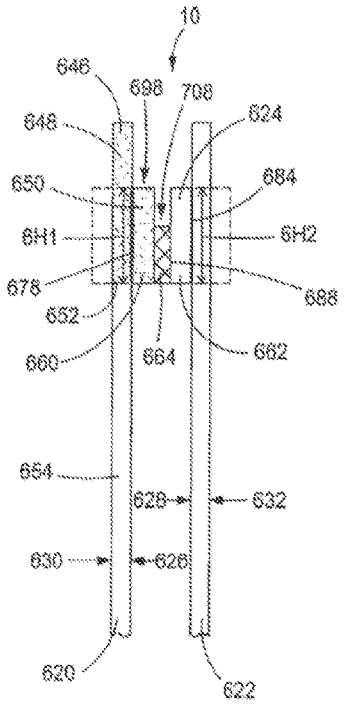
FIG. 6A is a detail, cross-sectional view of a package in a closed position according to another exemplary embodiment.
Figure 6B:
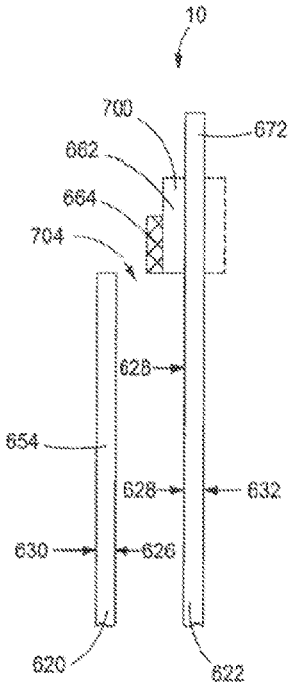
FIG. 6B is a detail, cross-sectional view of the package in an open position according to the exemplary embodiment of FIG. 6A.
Figure 6C:
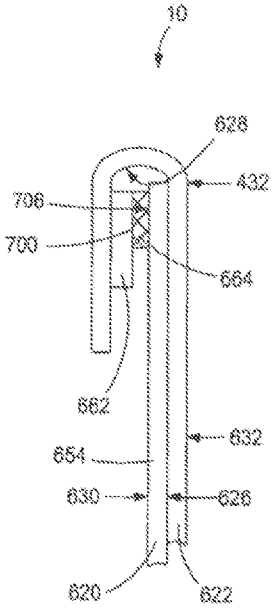
FIG. 6C is a detail, cross-sectional view of the package in resealed position according to the exemplary embodiment of FIG. 6A.

FIGS. 6A-6C show package 10 according to another exemplary embodiment. The exemplary embodiment of FIGS. 6A-6C includes a peel-reseal feature 624 that is a discrete element manufactured using a laminating process. Use of the laminating process to form the peel-reseal feature provides for selective positioning of the pressure sensitive adhesive within the peel-reseal feature. As will be discussed in more detail below, while this does not affect the method of using the package 10 (e.g., basic peel-reseal functionality), it does affect a failure path 688 that provides for a peel-off portion 646 to be removed from the package 10 when transitioning from the closed position to the open position.

FIGS. 6A-6C illustrate an exemplary embodiment of a package 10 that is a flexible package including a first wall panel 620 generally opposite a second wall panel 622. The peel-reseal feature 624 extends substantially the width of the package 10 from the first side 16 to the second side 18. The first wall panel 620 and the second wall panel 622 are polymeric webs that each include an interior surface 626, 628 and an exterior surface 630, 632, respectively. The first wall panel 620 and the second wall panel 622 are heat sealed together, the top heat seal 34 coupling the peel-reseal feature 624 between the wall panels 620, 622 in addition to coupling the wall panels 620, 622 together at the top end 12 of the package 10.

Referring in particular to FIG. 6A, the peel-reseal feature 624 includes a first panel that is heat-sealable, shown as a first panel 660, a second panel that is heat-sealable, shown as a second panel 662, and a pressure sensitive adhesive 664 disposed between the first panel 660 and the second panel 662 according to an exemplary embodiment. The first panel 660 of peel-reseal feature 624 is coupled to the first wall panel 620 by a first or skin panel heat seal 678. The bulk panel 662 of peel-reseal feature 624 is coupled to the second wall panel 622 by a second or bulk panel heat seal 684. The pressure sensitive adhesive 664 is disposed between the first panel 660 and the second panel 662, but is not disposed between the first panel 660 and second panel 662 at substantially all locations. Rather, the pressure sensitive adhesive 664 is shown extending generally from the first side 16 to the second side 18 of the package, like the first panel 660 and the second panel 662, but having a height that is less than the height of the first panel and the second panel such that a gap (e.g., spaces, openings, etc.) exists between the first panel 660 and second panel 662. As shown, the pressure sensitive adhesive 664 is substantially aligned with the panels 660, 662 at their bottom ends, leaving a gap 708 between the first panel 660 and the second panel 662 at an upper portion of the peel-reseal feature 624.

FIG. 6A shows the first heat seal 678 having a height 6H1 and the second heat seal 684 having a height 6H2, the heights 6H1 and 6H2 being substantially the same height and extending generally the entire height of the first panel 660 and second panel 662, respectively, of the peel-reseal feature 624 according to an exemplary embodiment. The bond strength of heat seals 678, 684 is greater than the peel force needed for the pressure sensitive adhesive 664 to fail adhesively, as will be discussed in more detail below. This heat seal configuration helps provide for the first panel 660 to fail at its interface with the pressure sensitive adhesive 664, rather than at its interface with the wall panel to which it is originally coupled, shown as the first wall panel 620.

FIG. 6A shows the first panel 660 and the second panel 662 having a similar thickness or bulk according to an exemplary embodiment. The heat seal configuration, the gap 708, and the fact that the pressure sensitive adhesive 664 is configured to fail adhesively help achieve the desired location of the preferential peelable interface between the first panel 660 and the pressure sensitive adhesive 664 when the package 10 is transitioned from the closed position to the open position. The heat seal configuration, the gap 708, and that the pressure sensitive adhesive 664 is configured to fail adhesively also contribute to the second panel 662 remaining intact and coupled to the second wall panel 622 when the package 10 is transitioned from the closed position to the open position.

Referring generally to FIGS. 6A-6C, upon application of a peeling force by a consumer, the peel-off portion 646 is separated from the package 10 to transition the package 10 from the closed position to the open position according to an exemplary embodiment. The peel-off portion 646 includes a first portion 648 of the first wall panel 620 and a first portion 650 of the peel-reseal feature 624. A second portion 700 of the peel-reseal feature 624 remains with the package 10 after the peel-off portion 646 has been removed. In the open position, pressure sensitive adhesive 664 of the second portion 700 is exposed, providing for resealability when the package is transitioned from the open position to the resealed position. In the resealed position, the pressure sensitive adhesive 664 is engaged with the exterior surface 630 of the second portion 654 of the first wall panel 620. Application of a peeling force may then be used to transition the package 10 back to the open position. Repeated transitioning between the open position and the resealed position is thereafter possible in a similar manner.

More specifically addressing the transition from the closed position to the open position and the transition from the open position to the resealed position illustrated in FIGS. 6A-6C according to an exemplary embodiment, with application of a generally transverse, downward, and outward peeling force, the gap 708 is extended and first panel 660 is pulled away from the second panel 662. The failure path 688 originates at the preferential peelable interface between the first panel 660 of the peel-reseal feature 624 and pressure sensitive adhesive 646. The failure path 688 then continues at this interface for substantially the entire length of the interface. Continued application of the peel force separates the first panel 660 from the pressure sensitive adhesive 664 and eventually results in separation of the first portion 648 of the first wall panel 620 from the second portion 654 at a location substantially corresponding to a line of weakness 652.

Continued application of the peeling force transversely progresses the above-described failure process until finally separating the peel-off portion 646 according to an exemplary embodiment. Separation of the peel-off portion 646 removes the first portion 648 of the first wall panel 620 and the first portion 650 of the peel-reseal feature 624 from the package 10. As shown, the first portion 650 of the peel-reseal feature 624 includes the first panel 660.

Now in the open position, FIG. 6B shows the pressure sensitive adhesive 664 exposed and an opening 704 to the cavity 44 of the package provided according to an exemplary embodiment. The second portion 700 of the peel-reseal feature 624 remains after opening, the second portion 700 including the exposed pressure sensitive adhesive 664 and the second panel 662. The second portion 700 of the peel-reseal feature 624 is shown coupled to the second wall panel 622 at a flap 672, providing for the second portion 700 to be movable therewith.

Referring to FIGS. 6B and 6C, the package 10 may be transitioned from the open position (FIG. 6B) to the resealed position (FIG. 6C) by folding the flap 672 over the second portion 654 of the first wall panel 620 to bring the pressure sensitive adhesive 664 into engagement with the exterior surface 630 of the first wall panel 620 according to an exemplary embodiment. The consumer may also apply pressure to the second wall panel 622 at/along the length for a portion of the length) of the pressure sensitive adhesive 664 to help ensure a strong and consistent reseal, Referring to FIG. 6C, the area of the exterior surface to which the pressure sensitive adhesive 664 is adhered is generally referred to as the reseal surface 706 according to an exemplary embodiment. The location of the reseal surface 706 may change depending on the manner in which the flap 672 is folded over to reseal the package 10; in fact, the location of the reseal surface may be at substantially any location on the exterior surface 430 of the first wall panel. For example, the consumer may fold over the flap 672 as shown in FIG. 6C such that only the flap 672 of the second wall panel 622 is folded over. According to other exemplary embodiments, a portion of the first wall panel and an additional portion of the second wall panel may be folded over along with the flap when resealing the package. With this manner of sealing, the reseal surface will be proximate the bottom end of the package relative to the reseal surface 706 as shown in FIG. 6C. This manner of resealing may be desirable if there is less product remaining the package and/or if it is desirable to expel air when resealing the package. Thus, the package 10 of this disclosure provides for beneficial flexibility in the manner of reseal.

FIG. 6C may be transitioned from the reseal position back to the open position of FIG. 6B by again applying a peeling force (e.g., generally upward). Repeated transition between the open position and the resealed position is possible while still maintaining a sufficient seal between the pressure sensitive adhesive and the exterior surface of the first wall panel in the reseal position.

While FIGS. 6A-6C show an unsealed header at least partially defined by the portions of the first and second wall panels 620, 622 extending above a top surface 698 of the peel-reseal feature 624, this need not be the case. According to some exemplary embodiments, the first wall panel and second wall panel extend generally to (or not much higher than) the top surface of the peel-reseal feature (e.g., generally corresponding to the top of the first and/or second panel of the peel-reseal feature). In such an embodiment, a consumer may still effectively be afforded a peel tab and be able to easily apply a peeling force due to the presence of a gap, which provides separation of the first wall panel and first panel from second wall panel and second panel.

According to an exemplary embodiment, the interior layers of the first and second panels of the peel-reseal feature are OPET to prevent them from heat sealing together. Beneficially, this helps ensure the gap is formed and prevents formation of a fusion seal (e.g., that would form if the interior layers of the first and second panels of the peel-reseal feature were heat sealable to one another) that could compromise the peelability of the package. Moreover, having the first and second panels have interior layers that are OPET, that are another material that is not heat sealable to itself, or that are a pairing of different materials that are not heat sealable to one another provides manufacturing benefits. For example, more flexibility is provided when forming the heat seals that couple the peel-reseal feature to the wall panels; no matter where the heat seal is made, there would still be a peelable header.

Referring generally to FIGS. 1 and 7-9, transitioning the package 10 from the closed position to the open position as well as transitioning the package 10 between the open position and the resealed position will be discussed according to an exemplary embodiment. While FIGS. 1 and 7-9 identify elements by the reference numbers used in association with the exemplary embodiment of FIGS. 3A-3D, FIGS. 1 and 7-9 may be considered representative of the exemplary embodiments discussed herein for the purposes of this discussion.

FIG. 1 shows the package 10 in the closed position wherein top heat seal 34 has sealed the package 10 at the end of the package through which product will be accessed as well as coupled the peel-reseal feature 24 to the wall panels 20, 22. In the closed position, the opening 104 has not yet been provided for accessing the product 42 disposed in the cavity 44 of the package 10. Further, the pressure sensitive adhesive 64 is disposed between the first and second panels 60, 62 of the peel-reseal feature 24; accordingly, the pressure sensitive adhesive is not yet exposed and not yet able to help provide for resealing of the package 10.

FIG. 9 shows the package 10 in transition from the closed position to the open position according to an exemplary embodiment. The peel-off portion 46 is shown being separated from the package 10 by application of a peeling force. As the peel-off portion 46 is being separated, the opening 104 is provided and the pressure sensitive adhesive of the peel-reseal feature 24 is exposed. The pressure sensitive adhesive is exposed at a second portion 100 of the peel-reseal feature 24 that remains coupled to the flap 72 of the second wall panel 22, the flap 72 being defined as the peel-off portion 46 is separated. Included in the peel-off portion 46 are the first portion 48 of the first wall panel 20 and the first portion 50 of the peel-reseal feature 24.

Figure 7:
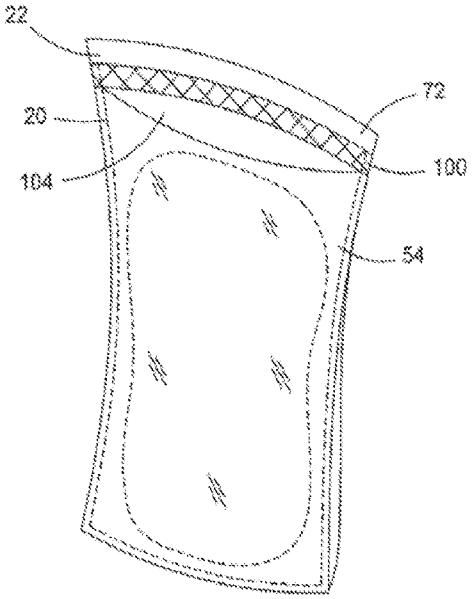
FIG. 7 is a perspective view of a package in an open position according to the exemplary embodiment of FIG. 1.

FIG. 7 shows the peel-off portion now fully separated from the package 10 and the package 10 in the open position according to an exemplary embodiment. The opening 104 is provided for accessing the product 42. Also, the pressure sensitive adhesive of the second portion 100 of the peel-reseal feature 24 is exposed and ready to be utilized in transitioning the package 10 from the open position to the resealed position.

FIG. 8 shows the package 10 in the resealed position having the pressure sensitive adhesive adhered to the exterior surface 30 of the second portion 54 of the first wall panel 20 according to an exemplary embodiment. To transition from the open position shown in FIG. 7, the flap 72 is folded over the top edge of the second portion 54 of the first wall panel 20. As the flap 72 is folded over, the second portion 100 of the peel-reseal feature 24 is moved toward the exterior surface 30 of the second portion 54, the pressure sensitive adhesive 64 of the second portion 100 being pushed into engagement with the exterior surface 30 and adheres thereto to reseal the package 10. From the reseal position, the package 10 can be transitioned back to the open position by again applying a peeling force to uncouple the pressure sensitive adhesive from the exterior surface 30 of the first wall panel 20. Repeated transition between the open position and the resealed position is thereafter possible.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features (e.g., to the precise numerical ranges provided). Accordingly, these terms should be interpreted as indicating that insubstantial or inconsequential modifications or alterations of the subject matter described and claimed are considered to be within the scope of the invention as recited in the appended claims.

The term "panel" can refer to a single layer or multilayer film. As used herein, the term "multilayer" refers to a plurality of layers in a single film generally in the shape of a sheet or web which can be made from a polymeric material or a non-polymeric material bonded together by any conventional means known in the art (i.e., coextrusion, extrusion coating, and lamination, vacuum vapor deposition coating, solvent coating, or suspension coating or any suitable combination of one or more thereof).

The term "film" is used in the generic to include plastic web, regardless of whether it is a film or sheet.

The term "web" is used in the generic to include a thermoplastic substrate having one or more structural layers. A "web" may include one or more paper or non-woven structural layers.

As used herein, the term "polymeric" refers to a material which is the product of a polymerization reaction of natural, synthetic, or natural and synthetic ingredients, and is inclusive of homopolymers, copolymers, terpolymers, etc. In general, the layers of a film or substrate may comprise a single polymer, a mixture of a single polymer and non-polymeric materials, a combination of two or more polymeric materials blended together, or a mixture of a blend of two or more polymeric materials and non-polymeric materials.

As used herein, the term "heat seal" refers to the union of a surface (or portion thereof) of one film to a surface (or portion thereof) of another film or two different portions of a surface of the same film using heat and pressure. The heat-seal is achieved by bringing two surfaces or portion of a surface into contact, or at least close proximity, with one another and then applying sufficient heat and pressure to a predetermined area of the two surfaces to cause the contacting surfaces to become molten and intermix with one another, thereby forming an essentially inseparable fusion bond between the two surfaces in the predetermined area when the heat and pressure are removed therefrom and the area is allowed to cool As used herein, the term "peelable" means that the separation may be achieved with application of a peel force within the range of 200 grams/inch to 2250 grams/inch, even more preferably 650 gram/inch to 1300 grams/inch.

As used herein, the term "barrier material" refers to an oxygen and/or water vapor barrier material. Barrier materials used in packaging film include, for example, polyvinyl alcohol copolymers, ethylene vinyl alcohol copolymers, polyvinyl chlorides, polyvinylidene chloride/methyl acrylate copolymers, polyester homopolymers and copolymers, polyolefin homopolymers and copolymers such as polypropylene, polyethylene, preferably, high density polyethylene, metals such as aluminum, zinc, nickel, copper, bronze, gold, silver, tin or alloys thereof, metal oxides, organometallic compounds, ceramics and mixtures thereof.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the package as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, any element disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A resealable flexible package including a closed position, an open position, and a resealed position, wherein the package comprises:

a top end;

a bottom end generally opposite the top end;

a first wall panel including an interior surface and an exterior surface;

a second wall panel including an interior surface and an exterior surface, the second wall panel being generally opposite the first wall panel;

a peel-reseal feature disposed between the interior surface of the first wall panel and the interior surface of the second wall panel, wherein the peel-reseal feature comprises:

a first heat-sealable panel;

a second heat-sealable panel; and a pressure sensitive adhesive disposed substantially between the first heat-sealable panel and the second heat-sealable panel; and a first portion of the first wall panel, the first portion of the first wall panel configured to be separated from a second portion of the first wall panel when transitioning from the closed position to the open position;

wherein, in the closed position, the first heat-sealable panel of the peel-reseal feature is coupled to the interior surface of the first wall panel at the first portion of the first wall panel and the second heat-sealable panel of the peel-reseal feature is coupled to the interior surface of the second wall panel;

wherein, in the open position, an opening is provided and the first portion of the first wall panel is separated from the second portion of the first wall panel;

wherein separating the first portion of the first wall panel from the second portion of the first wall panel also separates a first portion of the peel-reseal feature from a second portion of the peel-reseal feature, the second portion of the peel-reseal feature remaining coupled to the interior surface of the second wall panel after the first portion of the peel-reseal feature has been separated therefrom;

wherein in the resealed position, the pressure sensitive adhesive is adhered to an exterior surface of the first wall panel and is disposed between the first wall panel and the second wall panel, the exterior surface of the second wall panel being distal to the pressure sensitive adhesive relative to the interior surface of the second wall panel.

2. The package of claim 1, wherein the first portion of the peel-reseal feature includes at least a portion of the first heat-sealable panel.

3. The package of claim 1, wherein the pressure sensitive adhesive is configured to fail cohesively and to be exposed when the first portion of the first wall panel is separated from the second portion of the first wall panel.

4. The package of claim 1, wherein the first portion of the peel-reseal feature includes the second heat-sealable panel and at least a portion of the first heat-sealable panel of the peel-reseal feature.

5. The package of claim 1, wherein the second wall panel includes a flap, the flap configured to be positioned substantially over the opening in the resealed position.

6. The package of claim 1, wherein the second wall panel includes a flap, the second portion of the peel-reseal feature being coupled to the flap in the open position.

7. The package of claim 1, further comprising a line of weakness defined in the first wall panel, the line of weakness extending inward from the exterior surface of the first wall panel but not extending through to the interior surface of the first wall panel.

8. The package of claim 1, wherein the exterior surface of the first wall panel is corona treated to improve adhesion with the pressure sensitive adhesive.

9. The package of claim 1, wherein in the transition from the closed position to the open position includes a single step wherein the pressure sensitive adhesive is exposed and the opening is created.

10. A resealable flexible package, comprising:

a top end generally opposite a bottom end;

a first wall panel generally opposite a second wall panel, both the first wall panel and the second wall panel extending generally between the top end and the bottom end;

a peel-reseal feature disposed between an interior surface of the first wall panel and an interior surface of the second wall panel, wherein the peel-reseal feature comprises:

a skin panel coupled to the interior surface of one of the first wall panel and the second wall panel, the skin panel configured to fail when transitioning from the closed position to the open positioned;

a bulk panel coupled to the interior surface of the other of the first wall panel and the second wall panel, the bulk panel configured to remain substantially intact when transitioning from the closed position to the open positioned; and a pressure sensitive adhesive disposed generally between the skin panel and the bulk panel;

a peel-off portion, the peel-off portion including a first portion of the first wall panel and a first portion of the peel-reseal feature; and a line of weakness in the first wall panel, the first portion of the first wall panel being disposed to one side of the line of weakness and a second portion of the first wall panel being disposed to the other side of the line of weakness.

11. The package of claim 10, further comprising a first heat seal having a first height and a second heat seal having a second height, the second height being greater than the first height, the first heat seal coupling the skin panel to the interior surface of one of the first wall panel and the second wall panel, and the second heat seal coupling the bulk panel to the interior surface of the other of the first wall panel and the second wall panel.

12. The package of claim 10, wherein the skin panel is coupled to the first wall panel and the bulk panel is coupled to the second wall panel.

13. The package of claim 10, wherein the skin panel is coupled to the second wall panel and the bulk panel is coupled to the first wall panel.

14. The package of claim 10, wherein separation of the peel-off portion is configured to initiate at the interface of the skin panel of the peel-reseal feature and the wall panel to which the skin panel is coupled.

15. The package of claim 10, wherein the first portion of the peel-reseal feature includes at least a portion of the skin panel of the peel-reseal feature.

16. The package of claim 10, wherein the first portion of the peel-reseal feature includes the bulk layer of the peel-reseal feature and at least a portion of the skin panel of the peel-reseal feature.

17. The package of claim 10, wherein the line of weakness is disposed at or below a heat seal coupling the first wall panel and the peel-reseal feature.

18. A resealable flexible package having a closed position, an open position, and a resealed position, wherein the package comprises:

a top end;

a bottom end generally opposite the top end;

a first wall panel including an interior surface, an exterior surface, and a removable portion;

a second wall panel including an interior surface and an exterior surface;

a peel-reseal feature disposed between the interior surface of the first wall panel and the interior surface of the second wall panel, wherein the peel-reseal feature comprises:

a first panel coupled to the interior surface of h first wall panel by a first heat seal;

a second panel coupled to the interior surface of he second wall panel by a second heat seal; and a pressure sensitive adhesive disposed generally between the first panel and the second panel;

a peel-off portion including at least the removable portion of the first wall panel and a first portion of the peel-reseal feature;

a line of weakness disposed at or below a bottom end of the first heat seal; and a reseal surface disposed below the line of weakness, the reseal surface being a portion of the exterior surface of the first wall panel.

19. The package of claim 18, wherein the second wall panel further includes a flap, a second portion of the peel-reseal feature configured to remain coupled to the flap in the open position and in the resealed position.

20. The package of claim 18, wherein the line of weakness is further disposed at or above a bottom end of the first panel of the peel-reseal feature.

21. The package of claim 18, wherein removing the peel-off portion includes tearing through the first panel of the peel-reseal feature.

22. The package of claim 18, further comprising an unsealed header, the unsealed header configured to facilitate removal of the peel-off portion.

23. The package of claim 18, wherein the first wall panel includes at least two layers, the line of weakness extending through at least one layer, but not all layers, of the first wall panel.

24. The package of claim 18, wherein in the transition from the closed position to the open position includes a single step wherein the pressure sensitive adhesive is exposed and an opening is created.

* * * * *